US005966907A

United States Patent [19]

Julius

[11] Patent Number: 5,966,907

[45] Date of Patent: Oct. 19, 1999

[54] MULTI-STATION SEALING SYSTEM AND METHOD THEREFOR

[76] Inventor: Robert P. Julius, 11 Hycliff Rd., Greenwich, Conn. 06831

[21] Appl. No.: 08/976,068

[22] Filed: Nov. 21, 1997

[51] Int. Cl.[6] ..... B65B 9/10; B65B 7/06; B65B 51/26

[52] U.S. Cl. ..... 53/450; 53/479; 53/550; 53/567; 53/370.6; 53/371.7

[58] Field of Search ..... 53/450, 479, 550, 53/567, 370.6, 371.5, 371.6, 371.7

[56] References Cited

U.S. PATENT DOCUMENTS

| | | | |
|---|---|---|---|
| 1,875,979 | 9/1932 | Beutel | 56/370.6 |
| 2,606,856 | 8/1952 | Hurrey | 53/479 |
| 2,718,105 | 9/1955 | Ferguson et al. . | |
| 2,722,094 | 11/1955 | Forster . | |
| 3,017,731 | 1/1962 | Lohse | 53/370.6 |
| 3,347,015 | 10/1967 | Nuttng | 53/370.6 |
| 3,457,692 | 7/1969 | Gerlach . | |
| 3,738,081 | 6/1973 | Heinzer | 53/371.6 |
| 4,070,853 | 1/1978 | Sanders | 53/370.6 |
| 4,106,265 | 8/1978 | Aterianus | 53/550 |
| 4,299,075 | 11/1981 | Gram | 53/550 |
| 5,094,657 | 3/1992 | Dworak et al. . | |
| 5,191,750 | 3/1993 | Kammler . | |
| 5,433,063 | 7/1995 | Kovacs et al. . | |

FOREIGN PATENT DOCUMENTS

| | | | |
|---|---|---|---|
| 367404 | 12/1992 | Japan | 53/370.6 |
| 183418 | 7/1994 | Japan | 53/370.6 |

*Primary Examiner*—John Sipos

*Attorney, Agent, or Firm*—Lerner, David, Littenberg, Krumholz & Mentlik, LLP

[57] ABSTRACT

A system for packaging one or more articles surrounded by a tubular web moving downstream along a path includes a first station having a tacking jaw at a first downstream location along the path. The tacking jaw is movable between a first open position and a second closed position for sealing a central portion of the tubular web between the one or more articles. The first station also includes two tucking blades at the first downstream location on opposite sides of the tacking jaw and the tubular web. The tucking blades are movable toward one another for forcing the sides of the tubular web toward the central portion of the tubular web while the tacking jaw is in the closed position. The system also includes a second sealing station downstream from the first sealing station including a sealing jaw substantially perpendicular to the path of the tubular web. The sealing jaw extends completely across the tubular web and is movable between an open position and a closed position for completely sealing the tubular web between the articles. In preferred embodiments, the one or more articles and the tubular web is initially moved downstream along the path at a first rate of speed, whereby the first station and the second station travel downstream at successively slower speeds than the first rate of speed.

53 Claims, 8 Drawing Sheets

MULTI-STATION SEALING SYSTEM AND METHOD THEREFOR

FIELD OF THE INVENTION

The present invention relates to packaging machinery and is particularly directed to a multi-stage sealing system for wrapping and sealing articles in a flexible material.

BACKGROUND OF THE INVENTION

A variety of consumer products are packaged using a sealing machine, such as a horizontal form, fill and seal machine. Typically, a web of heat sealable thermoplastic film is moved downstream and is continuously formed around the products or articles being packaged. The tubular web and the articles then move to a sealing die which seals and severs the tubular web between the articles to provide individual sealed packages.

One of the earliest known sealing machines was developed in the late 1940's by Sam Campbell of the Hudson Sharp Company, of Green Bay, Wis. The machine, which became known in the industry as the "Campbell Wrapper," included a product in-feed conveyer, a horizontal forming shoulder for enveloping the product within a wrapping material, a rotary back-seam sealing device which acted as the prime mover for the wrapping material and horizontally rotating sealing bars which both sealed and cut the wrapping material. The Campbell Wrapper was designed for high-speed overwrapping of candy bars and the like.

The most critical element of any horizontal form, fill and seal machine is the sealing station because the articles must be effectively sealed in a package which 1) will not inadvertently open, 2) is structurally sound and 3) has all of the exterior graphics properly aligned and displayed thereon. In order to form a reliable heat seal using thermoplastic film, it is necessary to closely monitor and control three critical parameters during the sealing process, namely the amount of time the sealing die is closed over the material (hereinafter referred to as "dwell time"), the temperature of the die while sealing the material, and the pressure exerted by the die when compressing the material. The time, temperature and pressure parameters are highly interdependent so that if one of the parameters is lowered, one or more of the other parameters must be elevated. For example, if the dwell time is lowered to improve production rates, the temperature of and/or pressure exerted by the die must be increased.

The time, temperature and pressure parameters must also be elevated if the thickness of the material being sealed increases. Typically, the thickness of the material being sealed can vary widely from one seal to the next. This wide variation occurs because present sealing systems are incapable of positively controlling the exact location of the wrapping material during the sealing process including the alignment of tucks or folds in the package in relation to the position of the seals. As a result, excessive wrinkling or crumpling of the material may occur around some of the seals. The extra wrinkles make the material being sealed thicker and extra time, temperature or pressure must be used to properly seal the thicker material. Accordingly, either the sealing time, sealing temperature or sealing pressure must be elevated above normal levels in order to account for the wide variation in the thickness of the material which generally results in reduced production rates and/or wasting valuable resources.

U.S. Pat. No. 5,094,657 discloses one method and apparatus for maintaining better control of the wrapping material. After a low density polyethylene bag has been partially formed to provide pouches, a constant air flow is provided from an air manifold to keep the pouches open as they move downstream on a conveyor belt. The conveyor belt includes vacuum holes which pull on first sidewalls of the pouches while the constant airflow from the air manifold lifts second sidewalls thereof. The vacuum in the conveyor belt and the air manifold cooperatively open the sidewalls of the pouches so that the pouches may be filled with articles to be packaged.

When a package is sealed, it typically has protruding gabled ends adjacent the seals which must be tucked in at the sides and/or folded against the package to complete the packaging process. Tucking and folding the gables is typically accomplished by various mechanical arrangements which require precise timing. During the tucking step, it is critical that any wrinkling or crumpling of the material around the gables be avoided for the reasons set forth above and because any such wrinkling or crumpling, or any folding of the material at locations other than at the desired gable fold lines, may produce a defective seal resulting in leaks and/or contamination of the packaged articles.

There have been numerous advances directed to tucking or folding the sides of sealed packages. U.S. Pat. No. 5,191,750 discloses a sealing apparatus whereby tubular wrapping material is sealed by a closable cross sealing jaw and side folding rods positioned upstream from the cross sealing jaw are used to create folds or tucks in the sides of the wrapping material before the material is sealed. U.S. Pat. No. 2,722,094 discloses a wrapping and folding machine for covering packets with a wrapping material and carrying out the final folding and closing operations. After the package has been substantially wrapped, two tuckers are moved toward one another from opposite sides of the package so as to tuck in the wrapping material at the two rearward corners of the package. A downwardly depending folding flange at one end of the top folding plate turns down the upper rearwardly extending part of the wrapping material and the remaining rearward extension of the wrapping material is turned upwards by engagement with a fixed plate or bar at the end of the machine for completing the wrapping of the packet. U.S. Pat. No. 3,457,692 discloses a gable end folding method whereby the gables are folded by providing a line of sealed packages in end-to-end relationship and sequentially reducing the distance between the packages so that the gables engage one another and are constrained to fold.

Another problem associated with sealing machinery relates to the reduction in the downstream speed of the wrapping material when seals are formed between the articles. This reduction in speed occurs when the wrapping material is collapsed between successive articles to form a seal whereby the distance between the successive articles is decreased. The speed of the wrapping material must be reduced or the packaging material will stretch and/or tear, resulting in the formation of a defective package. Another benefit of reducing the speed of the wrapping material is that the packages are wrapped more tightly. These more tightly wrapped packages use less film and are more cosmetically appealing. The reduction in the speed of the wrapping material during sealing is not a problem in sealing machinery having only a single sealing jaw because only one seal and cut may be made at a time so that a package being sealed and cut can change velocity without restraint. However, whenever two or more sealing jaws are simultaneously in contact with the wrapping material, and where these multiple sealing jaws are operated at a constant velocity, the closing action of the sealing jaws pulls excess film from downstream which results in an undesirable jerking motion of the wrapping material. U.S. Pat. No. 5,433,632 discloses an apparatus whereby the speed of the articles to be packaged and the wrapping material is adjusted at a heat sealing station in order to compensate for the reduction in velocity due to deformation of the material between the articles. In other words, the articles to be packaged and the wrapping material are decelerated during the sealing and cutting operation in order to compensate for the reduction in the length of the material due to the formation of gables. The sealed and severed packages together with the packaged articles are then accelerated to the incoming web speed before exiting the sealing station of the machine. Although the '632 patent responds to the reduction in speed of the wrapping material, it would be preferable to slow down the material in stages to reduce the stress on the material.

U.S. Pat. No. 2,718,105 discloses a multi-stage sealing machine for sealing bag-like containers. A roll of flexible wrapping material is passed downstream to a first sealing station which seals the bottom sides of the container and forms a trough-like configuration in the bottom thereof. A second sealing station seals the sides of the container and a further station separates the cartons from the web. After the containers have been sealed along the sides, the containers pass downstream to a severing roll. The severing roll cuts the individual packages from the web and kicks the individual packages off at the ends where they are collected. The severing rolls rotate at a greater peripheral speed then the side sealing rolls so that the severed packages are given a thrust or kick and fall away from the end of the machine.

Despite these and other efforts in the art, there are needs for still further improvement.

SUMMARY OF THE INVENTION

In one embodiment of the present invention, a system for packaging one or more articles surrounded by a tubular web moving downstream along a path includes a moving element for moving the tubular web downstream and a first station having a tacking jaw at a first downstream location along the path. The tacking jaw is moveable between a first open position and a second closed position for sealing a central portion of the tubular web between the articles. The station also includes two tucking blades located at the first downstream location on opposite sides of the tacking jaw and the tubular web. The tucking blades are moveable toward one another for forcing the sides of the tubular web inward toward the central portion of the tubular web while the tacking jaw is in the closed position.

The tacking jaw has a first axis, preferably a longitudinal axis, which is substantially perpendicular to the downstream path of the tubular web. The tacking jaw also has opposed upper and lower tacking elements including opposed central sealing sections which are in contact with one another with the tubular web therebetween when the tacking jaw is closed for sealing the central portion of the tubular web. The opposed central sealing sections may include knurled surfaces for gripping the tubular web before the central portion of the web is compressed between the central sealing sections. Each of the opposed tacking elements includes lateral sections which extend outwardly along the first axis of the tacking jaw, from opposite sides of the central sealing section. In other words, a first axis extending across the central sealing section and the lateral sections of each opposed tacking element lies substantially perpendicular to the downstream path of the tubular web. The lateral sections of the opposed upper and lower tacking elements are substantially mirror images of one another and define openings on opposite sides of the tacking jaw. The openings provide clearance for the tucking blades when the tacking jaw is in the second closed position. The lateral sections of the opposed upper and lower sealing elements may slope away from one another for providing the side openings. In other preferred embodiments the tacking jaw may be relatively narrow and/or may taper inwardly from the central sealing section toward the lateral sections. In still other embodiments the upper and lower tacking elements taper inwardly toward the central sealing section. The various embodiments including the narrow and/or tapered tacking jaw provide an element which contacts as small an area of the tubular web as is necessary to adequately seal the central portion thereof, thereby resulting in the formation of more tightly wrapped packages which, in turn, use less wrapping material. The lateral sections may also include a securing element for securing intermediate portions of the tubular web extending laterally from the central sealing sections of the tacking jaw. The securing element holds the tubular web in an expanded position during the tacking and tucking operations so that excess folds or wrinkles do not form in the web. The securing element may include one or more vacuum holes provided in the lateral sections whereby a vacuum is activated through the vacuum holes for suctioning the intermediate portions of the tubular web. In other embodiments the securing element may include a clipping unit. The tacking jaw may also include a heating element for heat sealing the central portion of the tubular web while the tacking jaw is in the closed position.

The tucking blades are preferably located at a downstream location which is identical to the downstream location of the tacking jaw. By providing the tucking blades at the same downstream location as the tacking jaw, it is possible to obtain more positive control over the tubular web during the sealing steps. During a folding and/or tucking operation, the tucking blades extend toward one another along the first axis of the tacking jaw so that the interior ends of the tucking blades are adjacent the opposed central sealing sections while the tacking jaw is in the second closed position. The openings or clearance on the opposite sides of the tacking jaw allow the tucking blades to freely pass between and be withdraw from the tacking jaw while the tacking jaw is in the closed position. In certain preferred embodiments the tucking blades extend inwardly toward one another before the tacking jaw closes. In other preferred embodiments the tacking jaw is closed before the tucking blades begin to extend between the openings in the tacking jaw. In any event, the tucking blades should be able to freely pass between the upper and lower tacking elements when the tacking jaw is in the closed position.

Although the present invention is not limited by any particular theory of operation, it is believed that positive control of the tubular web during the tacking and tucking operations is enhanced by placing the tucking blades at the identical downstream location as the tacking jaw. Positive control is also enhanced by providing a tacking jaw having side openings, whereby the tucking blades may freely move in and out of the side openings when the tacking jaw is in the closed position. The terminology "enhanced positive control" means that the sealing system of the present invention provides additional shaping and forming elements which engage the tubular web so that the final shape of the tubular web and the thickness of the material being sealed can be accurately controlled. None of the prior art references disclose a tacking jaw having side openings which enable the tucking blades to freely move in and out of the side openings when the tacking jaw is in the closed position. As a result, in these prior art systems the shape of the gables formed on the opposed upstream and downstream sides of the seal may differ dramatically, thereby causing wide variations in the thickness of the material at the seal. This wide variation in thickness is undesirable because excessive time, temperature and/or pressure must be used to account for those instances when the material being sealed is thicker than normal. Thus, the sealing systems of the present invention provide enhanced positive control of the tubular web material during the sealing process thereby minimizing the likelihood that the thickness of the material being sealed will vary so that the dwell time, temperature and pressure parameters can be established and maintained at lower levels. The securing element, such as the vacuum holes or clipping unit described above, also enhances positive control of the sealing process by positioning the tubular web in a preferred location with respect to the tucking blades so that the intermediate portions of the tubular web are not engaged by the tucking blades and forced toward the central portion of the web which could cause excess wrinkling of the tubular web around the seal, thereby leading to the problems discussed above.

The system for packaging one or more articles according to the present invention also includes a second station located downstream from the first station having a sealing jaw which is substantially perpendicular to the path of the tubular web. The sealing jaw extends completely across the width of the tubular web, i.e., from one side of the tubular web to the other side of the tubular web and is movable between an open position and a closed position for completely sealing the tubular web between the one or more articles while in the closed position. The sealing jaw has opposed upper and lower sealing elements with at least one of the sealing elements including two substantially parallel sealing blades. When the sealing jaw is activated for completely sealing the tubular web, the two substantially parallel sealing blades overlie and compress the central portion of the tubular web which was previously sealed upstream at the first station. The two substantially parallel sealing blades may include a knurled surface for gripping the tubular web before the web is compressed and sealed between the sealing elements. The sealing element having the two parallel sealing blades may include a cutting element, such as a cutting blade, located between the two substantially parallel sealing blades. When the upper and lower sealing elements are activated, the cutting element abuts against its opposed sealing element and severs the tubular web between the two substantially parallel sealing blades for providing individual sealed packages. In other preferred embodiments, the cutting element may be located downstream from the second sealing station. The opposed sealing elements may include a heating element connected thereto for heat sealing the tubular web while the sealing jaw is activated.

In other embodiments, the cutting element does not abut against its opposed sealing element for severing the tubular web. In these particular embodiments, both opposed upper and lower sealing elements include two substantially parallel sealing blades which abut against one another when the sealing jaw is closed for completely sealing the tubular web. One of the upper and lower sealing elements may include a cutting blade or knife located between the two substantially parallel sealing blades. When the sealing jaw is closed, the tubular web material is secured tautly between the parallel sealing blades so that the cutting blade may sever the tubular web material between therebetween to provide individual sealed packages.

The various embodiments of the sealing system described above may be used in various methods for packaging one or more articles surrounded by a tubular web moving downstream along a path. One preferred method for packaging includes providing a tacking jaw at a first downstream location along the path which is movable between a first open position and a second closed position and providing tucking blades at the first downstream location on opposite sides of the tacking jaw and the tubular web. The method also includes moving the tucking blades toward one another for tucking or forcing the sides of the tubular web toward a central portion thereof and closing the tacking jaw and sealing the central portion of the tubular web between the articles during the moving step. During the closing step, the opposed central sealing sections of the upper and lower tacking elements abut against one another for compressing and sealing the central portion of the tubular web therebetween. In certain embodiments, the closing the tacking jaw step includes the step of securing an intermediate portion of the tubular web extending laterally from the central sealing sections. When the tucking blades are fully extended through the openings on the opposed lateral sides of the tacking jaw, the ends of the tucking blades are positioned adjacent the opposed central sealing sections. The tacking jaw, the securing element on the tacking jaw and the tucking blades cooperatively provide for positive control of the tubular web during the tacking and tucking steps so that the shape and thickness of each seal and the shape of the gables are uniform. Thus, the time, temperature and pressure parameters can be reduced to lower levels because the likelihood of a "thick" seal being formed is greatly reduced. In addition, because the dwell time, temperature and pressure parameters are reduced, the overall production rates will increase because the wrapping material may move downstream at a faster rate. Moreover, the wrapping material utilized may include less rugged materials, i.e., thinner materials, thereby reducing packaging costs. After the central portion of the tubular web has been sealed at the tacking jaw, the tubular web passes downstream to the sealing jaw which is then closed to compress and completely seal the tubular web between the articles. The completely sealed portion of the tubular web is then cut to provide individual sealed packages.

In other preferred embodiments of the present invention, the tacking jaw, tucking blades and sealing jaw may be substantially similar to those described above and the articles to be packaged and the tubular web move downstream along a path at a first rate of speed. The system includes a first station having a tacking jaw movable between open and closed positions for partially sealing the tubular web between the one or more articles. The first station travels downstream at a second rate of speed which is slower than the first rate of speed of the tubular web when the tacking jaw is in the closed position for partially sealing the tubular web. The first station may also include two tucking blades provided on opposite sides of the tacking jaw and the tubular web. The tucking blades are movable toward one another for forcing the sides of the tubular web toward the partially sealed portion of the tubular web while the tacking jaw is in the closed position. The sealing system in this embodiment also includes a second station downstream from the first station including a sealing jaw movable between open and closed positions for completely sealing the tubular web between the articles. The second station travels downstream at a third rate of speed which is slower than the second rate of speed while the sealing jaw is in the closed position.

In operation, the sealing system moves the tubular web and the articles downstream at a first rate of speed. The first sealing station then partially seals the tubular web between the one or more articles. While partially sealing the tubular web, the first sealing station moves downstream at a second rate of speed which is slower than the first rate of speed of the tubular web. The partially sealing step includes the step of closing the tacking jaw and sealing a central portion of the tubular web. The partially sealing step may also include moving the tucking blades toward one another and forcing the opposing sides of the tubular web toward the sealed central portion. The tubular web is then completely sealed at the second sealing station which moves downstream at a third rate of speed which is slower than the second rate of speed. The second sealing station moves downstream at the third rate of speed while the sealing jaw is closed for completely sealing the tubular web.

The present invention serves to minimize the level of stress exerted upon the tubular web during the sealing process because the web speed is not reduced from the incoming web speed to a final web speed in one step as taught by above-mentioned U.S. Pat. No. 5,433,632, but is slowed down in a gradual, multi-stage process consisting of two or more stages. By using two or more sealing stations having successively slower speeds, the system minimizes the stress placed upon the web material so that the wrapping material may comprise a wider array of materials, such as a thin film of flexible material. The present invention also improves overall production rates because the "enhanced positive control" of the tubular web material allows the heat, pressure and dwell time parameters to be minimized so that a greater number of articles can packaged and sealed in the same amount of time. In addition, the sealing process may be completed in less time because the tucking blades are free to pass through the sides of the tacking jaw when the tacking jaw is closed so that there is no need to withdraw the tucking blades before closing the tacking jaw.

The present invention also improves the aesthetic appearance of the sealed packages. By providing the tucking blades at the same downstream location as the tacking jaw so that the tucking blades can pass through openings at the sides of the tacking jaw, the gable folds formed upstream and downstream of the seal will be substantially identical, thereby resulting in the formation of uniform and aesthetically pleasing gables. Another benefit of the present invention is that the gables at the leading edge of each package will be neatly tucked inward toward the article as the package is sealed and severed from the tubular web.

The foregoing and other objects and advantages of the present invention will be better understood from the following Detailed Description of Preferred Embodiments, taken together with the attached drawings.

DETAILED DESCRIPTION OF PREFERRED EMBODIMENTS

Figure 1:
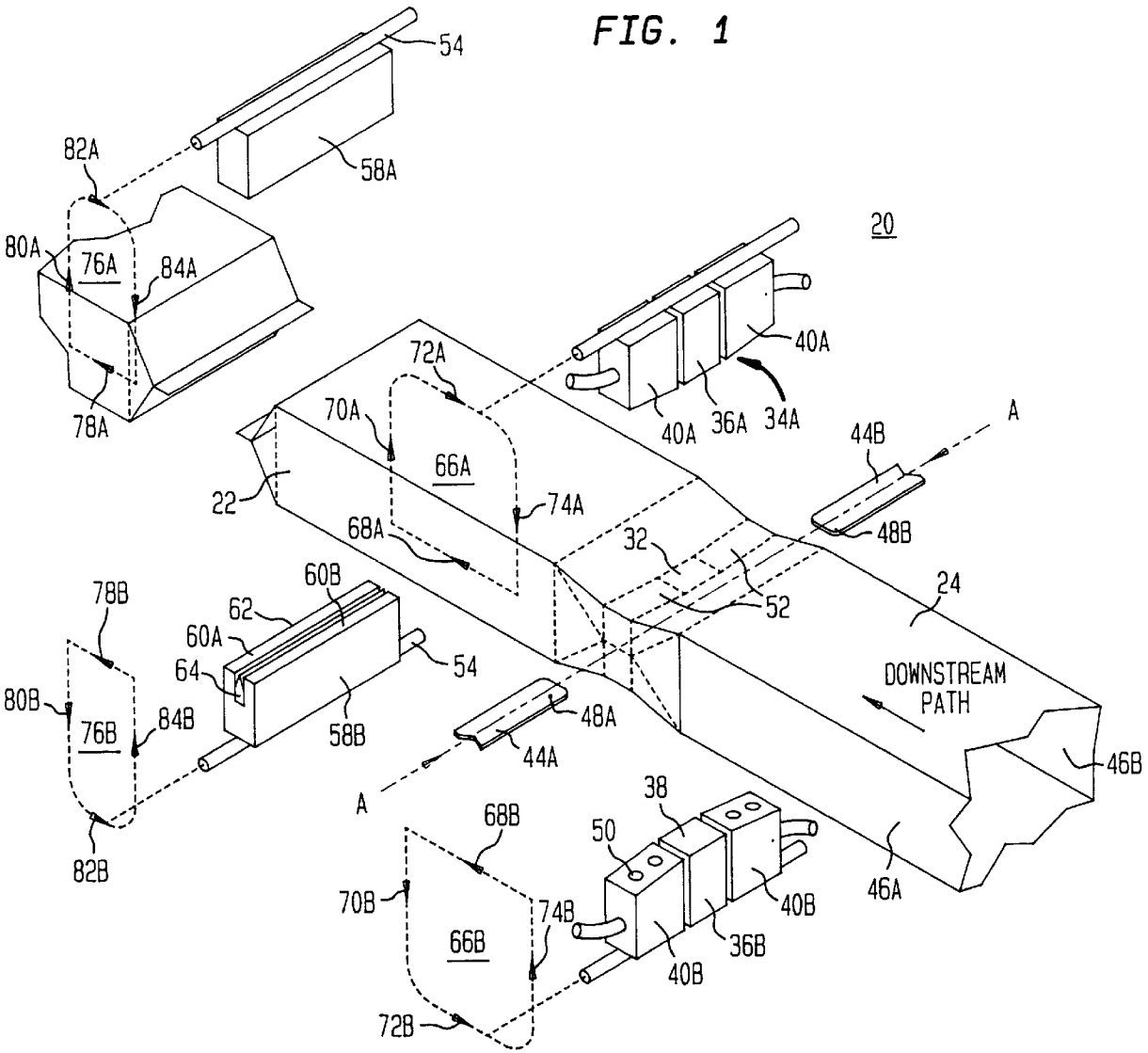
FIG. 1 shows a fragmentary, exploded view of one embodiment of the present invention including a tubular web of wrapping material, a tacking jaw, tucking blades and a sealing jaw.
Figure 2:
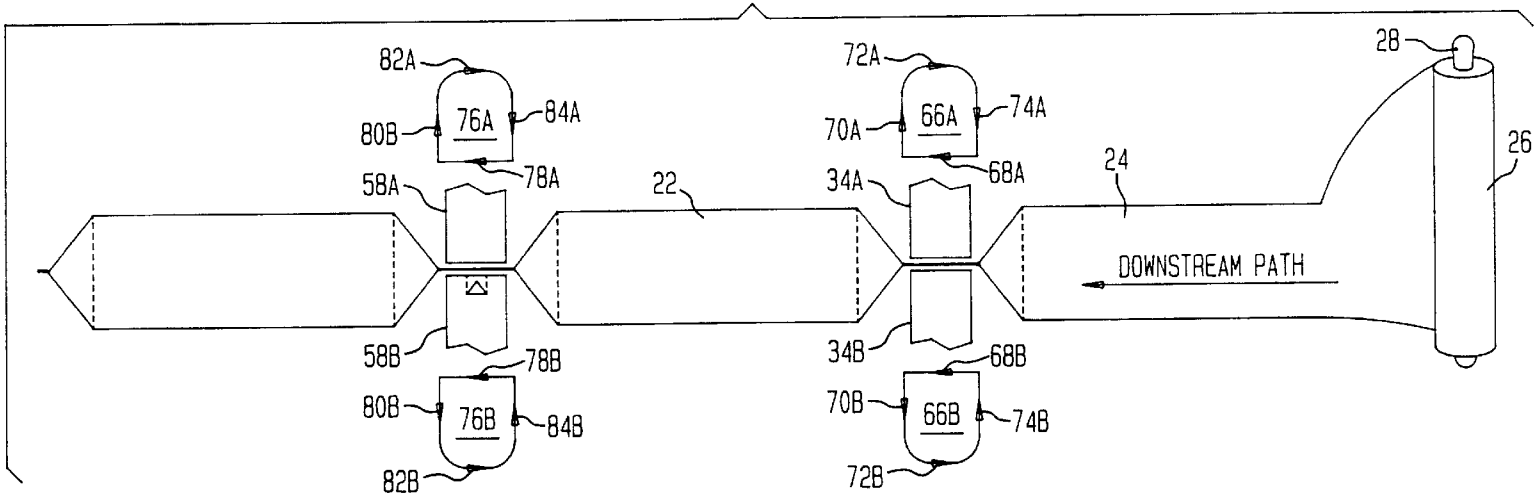
FIG. 2 shows a schematic side view of a sealing system according to one embodiment of the present invention.
Figure 3:
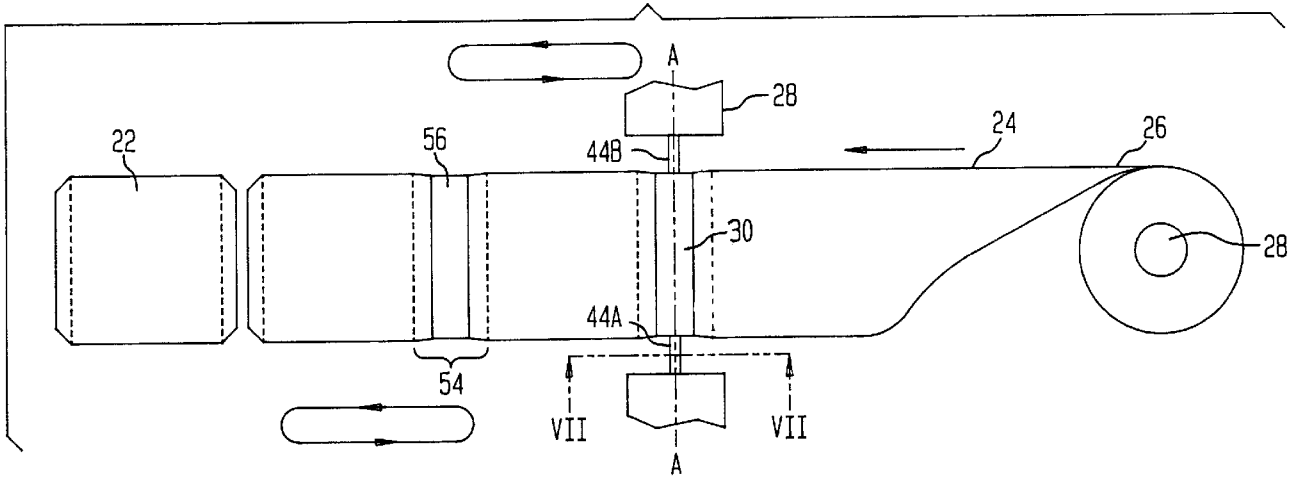
FIG. 3 shows a top view of FIG. 2.
Figure 4:
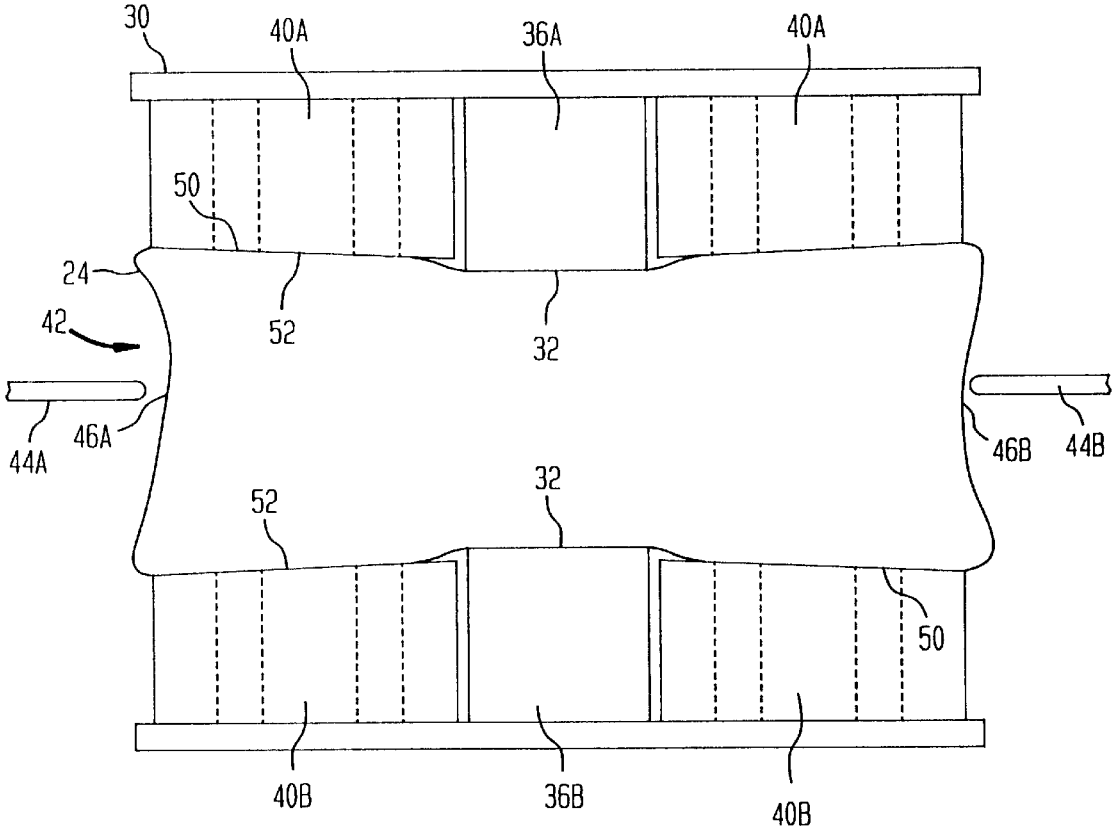
FIGS. 4–6 shows a fragmentary view of various stages of a sealing process according to the present invention.
Figure 6:
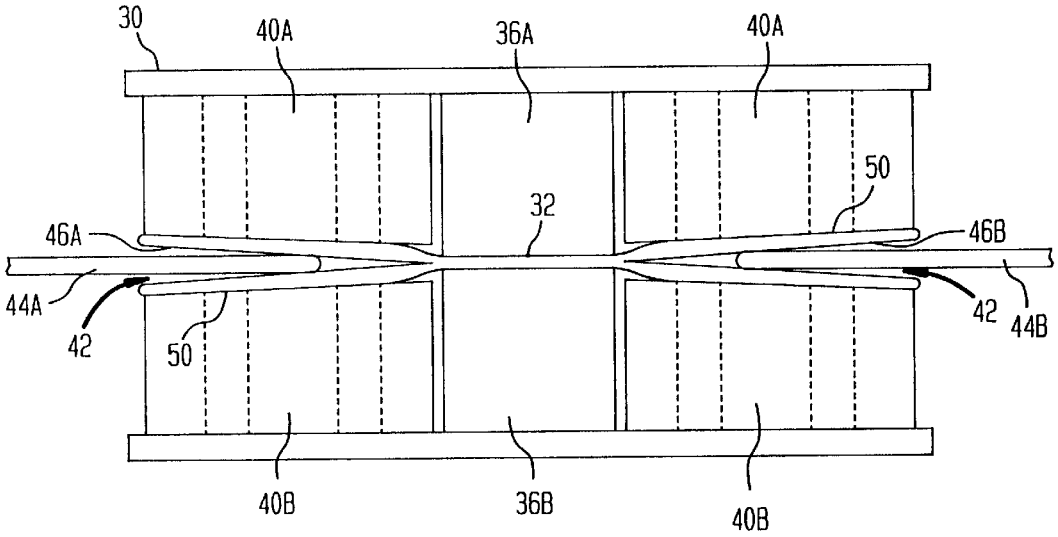

FIGS. 1–3 show perspective, side and top views, respectively, of a system 20 for packaging one or more articles 22 surrounded by a tubular web 24. Referring to FIGS. 2 and 3, initially, a material 26 for wrapping the packages, such as a flexible heat sealable film, is provided on a roll 28 at an upstream location. In preferred embodiments the wrapping material 26 includes two layers, a first layer which is printable for bearing graphical information and a second layer of an adhesive, such as a heat- or cold-sealable adhesive. The material is conveyed downstream and passed over a forming sleeve (not shown) to provide the tubular web 24 enveloping or surrounding the articles 22 to be packaged. The tubular web 24 and the articles 22 then move downstream along a path to a first station 28 for partially sealing the tubular web 24 between the one or more articles 22. The first station 28 includes a tacking jaw 30 which is movable between a first open position and a second closed position for sealing a central portion 32 of the tubular web 24 between the one or more articles 22. The tacking jaw 30 is at a first downstream location along the path of the tubular web and has a first axis A—A which is substantially perpendicular to the path. The axis A—A also defines the downstream location of the tacking jaw 30. Referring to FIGS. 1 and 4, the tacking jaw includes opposed upper and lower tacking elements 34A, 34B which are substantially mirror images of one another. The opposed tacking elements 34A, 34B include opposed central sealing sections 36A, 36B which are in contact with one another while the tacking jaw 30 is in the second closed position. The opposed central sealing sections 36A, 36B include knurled surfaces 38 for gripping the central portion 32 of the tubular web 24 before the central portion 32 is compressed therebetween. Each of the opposed upper and lower tacking elements 34A, 34B includes lateral sections 40A, 40B which extend outwardly from the opposite sides of the opposed central sealing sections 36A, 36B along the axis A—A. As shown in FIG. 6, the lateral sections 40A, 40B of the opposed tacking elements 34A, 34B slope away from one another to define openings 42 on opposed lateral sides of the tacking jaw 30 when the tacking jaw is in the closed position.

Referring to FIGS. 1 and 3–7, the first station 28 also includes two tucking blades 44A, 44B provided on opposite sides of the tacking jaw 30 and the tubular web 24. The two tucking blades 44A, 44B are located at the same downstream location as the tacking jaw (i.e., the first downstream location defined by the axis A—A.). The tucking 44A, 44B are movable toward one another along the axis A—A for forcing the sides 46A, 46B of the tubular web 24 toward the central portion 32 of the tubular web 24 while the tacking jaw 30 is in the closed position. In other words, when the tacking jaw 30 is in the second closed position, the respective ends 48A, 48B of the tucking blades 44A, 44B may freely pass between the lateral sections 40A, 40B of the opposed upper and lower tacking elements 34A, 34B whereby the ends 48A, 48B of the tucking blades 44A, 44B are adjacent to the opposed central sealing sections 36A, 36B when the tucking blades 44A, 44B are fully extended.

Figure 12:
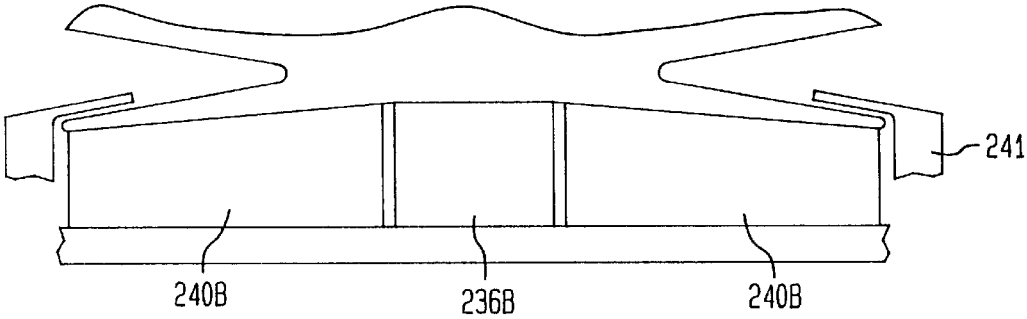
FIG. 12 shows a fragmentary view of the tacking jaw shown in FIG. 1 according to yet another embodiment of the invention.

Referring to FIGS. 4–8, in preferred embodiments, the opposed tacking elements 34A, 34B include a securing element, such as one or more vacuum holes 50, in the lateral sections 40A, 40B thereof for securing an intermediate portion 52 of the tubular web 24 between the central portion 32 and the sides 46A, 46B of the tubular web 24. A vacuum is activated to provide suction at the one or more vacuum holes 50 in the lateral sections 40A, 40B so that as the tacking jaw 30 closes to compress and seal the central portion 32 of the tubular web 24, the intermediate portions 52 of the tubular web are secured by the vacuum holes 50. The vacuum holes 50 assist in the tucking and sealing operation by enhancing positive control of the tubular web 24 by holding the intermediate portions 52 of the tubular web 24 against the lateral sections and away from the path of the tucking blades 44A, 44B as the tucking blades extend inward toward the central portion 32 of the tubular web 24. If the intermediate portions 52 of the tubular web 24 are not held away from the path of the tucking blades 44A, 44B, then undesirable wrinkles or folds can form around the seals in the tubular web 24 thereby causing some of the seals to be thicker than others as discussed above. In other embodiments, the securing element may include a clipping unit on the lateral sections of the tacking jaw as shown in FIG. 12. The tacking jaw may also include a heating element for heating the central portion 32 of the tubular web 24 while the tacking jaw 30 is in the closed position. Preferably, the heating element is connected to the opposed central sealing sections 36A, 36B of the tacking jaw.

Figure 5:
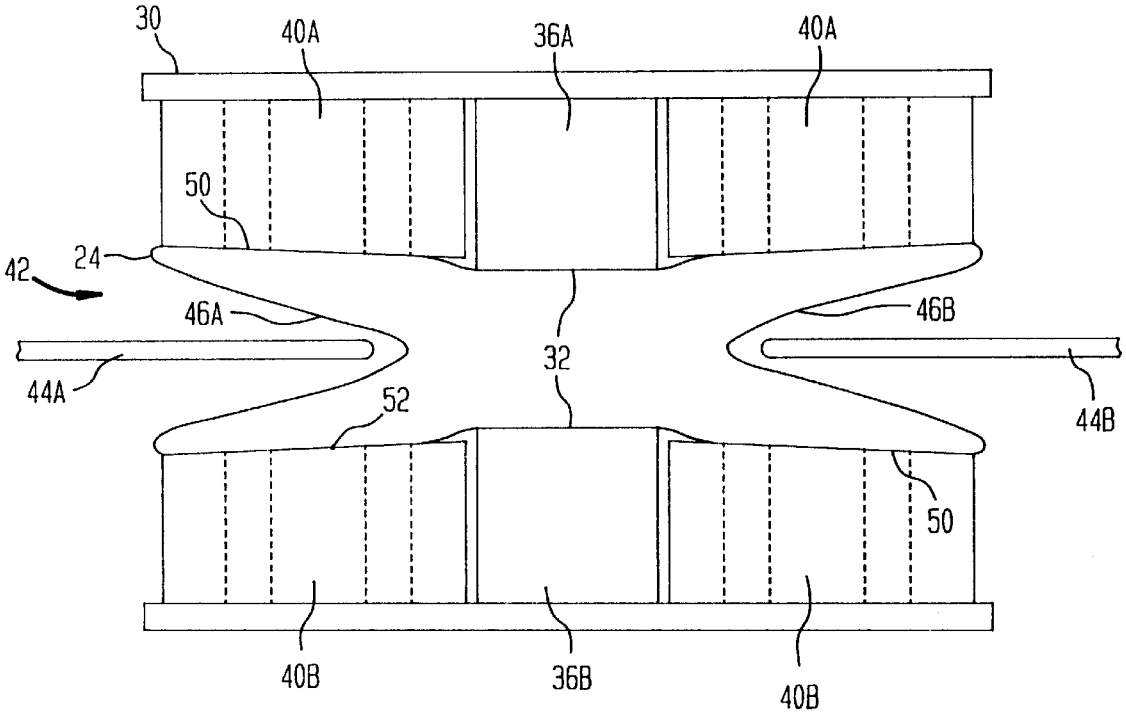
Figure 7A:
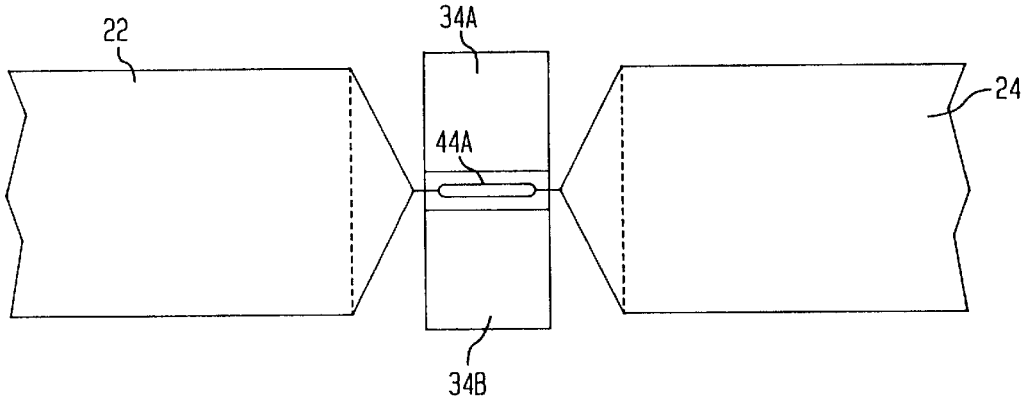
FIG. 7A shows a fragmentary side view of FIG. 3 along section line VII-VII.

At the first station 28, the tubular web 24 is partially sealed by sealing the central portion 32 thereof and forcing the sides 46A, 46B of the web 24 toward the central portion 32. FIG. 4 shows the tubular web 24 at the first station 28 between the opposed upper and lower tacking elements 34A, 34B of the tacking jaw 30. When opposed central sealing sections 36A, 36B are in contact with the central portion 32 of the tubular web 24, the vacuum holes 50 in the lateral sections 40A, 40B of the tacking jaw 30 are activated in order to hold the intermediate portions 52 of the tubular web 24 away from the path of the tucking blades 44A, 44B. In FIG. 5, as the tacking jaw 30 closes, the central sealing sections 36A, 36B of the upper and lower sealing elements 34A, 34B move toward one another. Simultaneously, the tucking blades 44A, 44B force the sides 46A, 46B of the tubular web 24 toward the central portion 32 thereof. The vacuum force in the vacuum holes 50 continues to hold the intermediate portions 52 of the tubular web 24 against the lateral sections 40A, 40B of the upper and lower tacking elements 34A, 34B. As previously described, if the vacuum holes 50 did not maintain the intermediate portions 52 of the tubular web 24 out of the path of the tucking blades 44A, 44B, then the intermediate portions 52 could fall into the path of the tucking blades 44A, 44B and be forced toward the central portion 32 of the tubular web 24, thereby causing excessive wrinkling of the tubular web 24 and increasing the thickness of the material being sealed. FIG. 6 shows later stages of the process whereby the central portion 32 of the tubular web 24 is heat sealed between the central sealing sections 36A, 36B as the ends of the tucking blades 44A, 44B are fully extended between the openings 42 on the opposite sides of the tacking jaw 30. The ends 48A, 48B of the tucking blades 44A, 44B are free to pass between the openings 42 in the lateral sections of the upper and lower tacking elements. The openings 42 are defined by the lateral sections 40A, 40B which slope away from one another. FIG. 7A shows a side view of FIG. 6 with the tucking blades 44A, 44B positioned between the upper and lower tacking elements 34A, 34B while the tacking jaw 30 is sealing the central portion 32 of the tubular web 24.

Figure 7B:
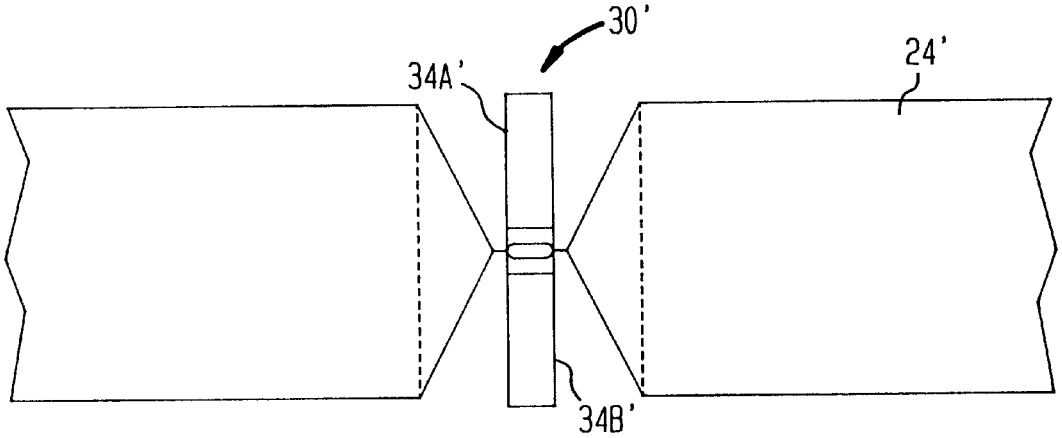
FIG. 7B shows a fragmentary side view of the tacking jaw of FIG. 1 according to another embodiment of the present invention.
Figure 7C:
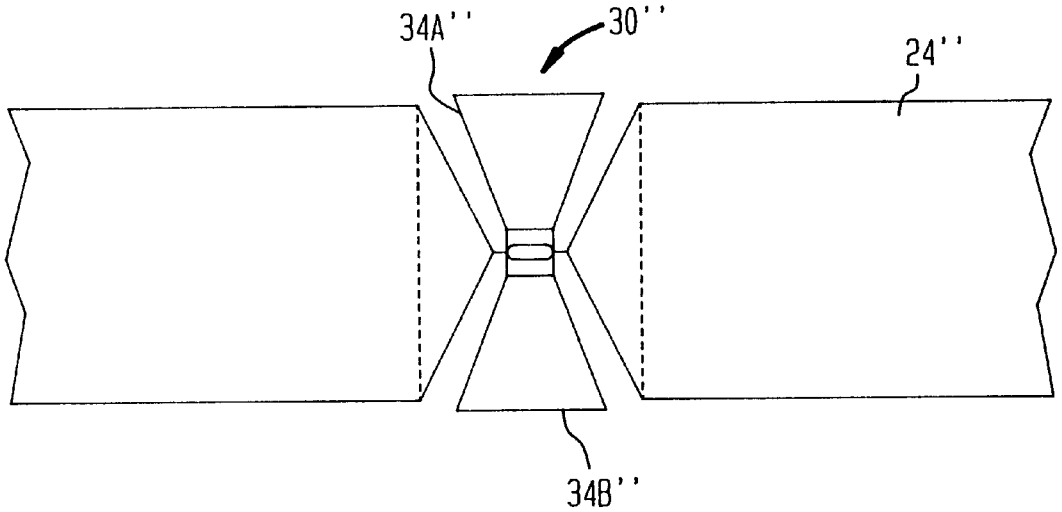
FIG. 7C shows a fragmentary side view of the tacking jaw of FIG. 1 according to still another embodiment of the present invention.

FIGS. 7B and 7C show side views of tacking jaws according to other preferred embodiments of the present invention. The tacking jaw 30' shown in FIG. 7B is relatively narrow so that the upper and lower tacking elements 34A' and 34B' engage as small an area of the tubular web material 24' as is necessary to adequately seal the central portion thereof. The narrow design of the tacking jaw 30' minimizes the forces exerted upon the tubular web material 24' during the tacking and tucking operations which results in increased production rates, more tightly wrapped packages and the use of less wrapping material.

Referring to FIG. 7B, the tacking jaw 30" according to this preferred embodiment is tapered inwardly from the upper and lower tacking elements 34A" and 34B" toward the central sealing sections 36A" and 36B". The tapered design of the tacking jaw 30" shown in FIG. 7C minimizes the forces exerted upon the tubular web material 24" to provide the benefits described above.

Figure 8:
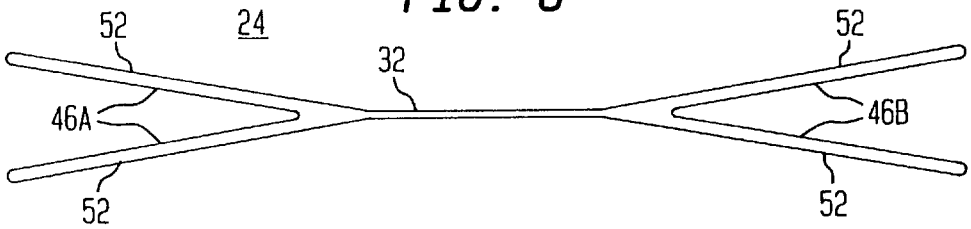
FIG. 8 shows a fragmentary view from the upstream side of the tubular web shown in FIG. 1 after the web has been partially sealed by the tacking jaw.
Figure 9:
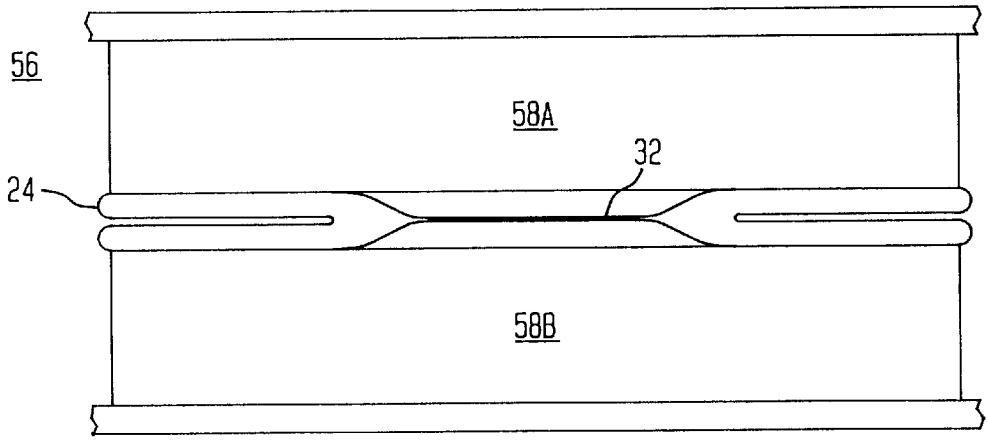
FIG. 9 shows a fragmentary view of further stages of a sealing process according to the present invention.
Figure 10A:
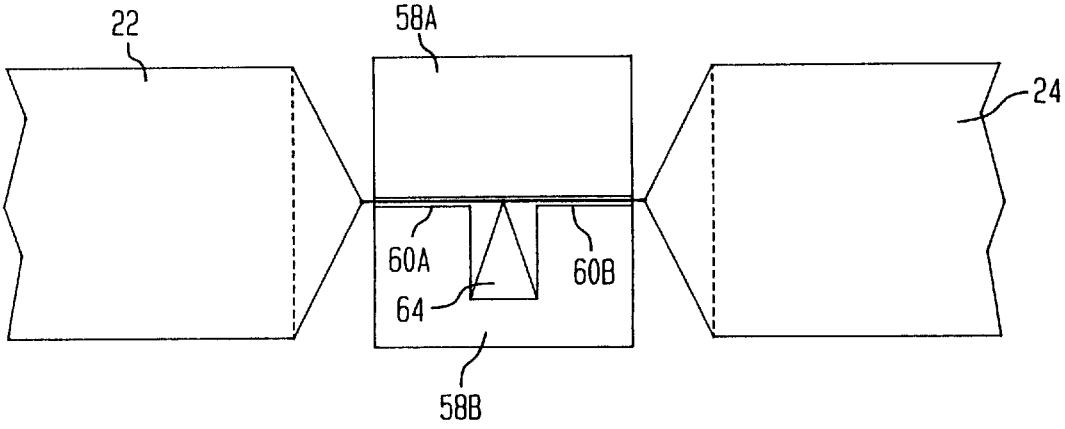
FIG. 10A shows a cross-sectional side view of the sealing jaw shown in FIGS. 1 and 9.

After the tubular web 24 has been partially sealed between the articles 22 at the first station 28, the tubular web 24 passes downstream to a second station 54. FIG. 8 shows the configuration of the tubular web 24 after it has been partially sealed and as it passes between the first and second stations. The central portion 32 of the tubular web 24 is sealed together and includes two layers of the tubular web material. The sides 46A, 46B of the tubular web 24 are folded inwardly toward the central portion 32 so that the sides 46A, 46B and the intermediate portions 52 of the tubular web have a butterfly-like wing appearance. As is evident from FIG. 8, because the tubular web 24 has been positively controlled during the sealing and tucking steps at the first station 28, the maximum thickness of the tubular web 24 will not exceed four layers of material. As set forth above, since the maximum thickness of the tubular web 24 in this embodiment will not exceed four layers, the sealing parameters of time, temperature and pressure can be maintained at the lowest required level for sealing four layers of material and will not have to be elevated to account for "thicker" seals. Referring to FIGS. 9 and 10A, the second station 54 includes a sealing jaw 56 which is substantially perpendicular to the downstream path of the tubular web 24. The sealing jaw 56 extends completely across the tubular web 24 and is movable between an open position and a closed position for completely sealing the tubular web 24 between the articles 22. The sealing jaw 56 includes opposed upper and lower sealing elements 58A, 58B whereby at least one of the sealing elements includes two substantially parallel sealing blades 60A, 60B. When the sealing jaw 56 engages the tubular web 24, the two substantially parallel sealing blades 60A, 60B overlie the central portion 32 of the tubular web 24 which has been previously sealed at the first station 28. In preferred embodiments, the substantially parallel sealing blades 60A, 60B include knurled surfaces 62 for gripping the tubular web 24 when the tubular web is being compressed therebetween. Preferably, the opposed sealing elements 58A, 58B include a heating element connected thereto for heating the sealing blades 60A, 60B which in turn heat seal the tubular web while the sealing jaw 56 is in the closed position. The sealing element 58B having the two substantially parallel sealing blades 60A, 60B preferably includes a cutting element 64 between the two substantially parallel sealing blades 60A, 60B for severing a sealed package from the tubular web. In other embodiments, the cutting element 64 may also be located downstream from the second sealing station 54 and the sealing jaw.

Figure 10B:
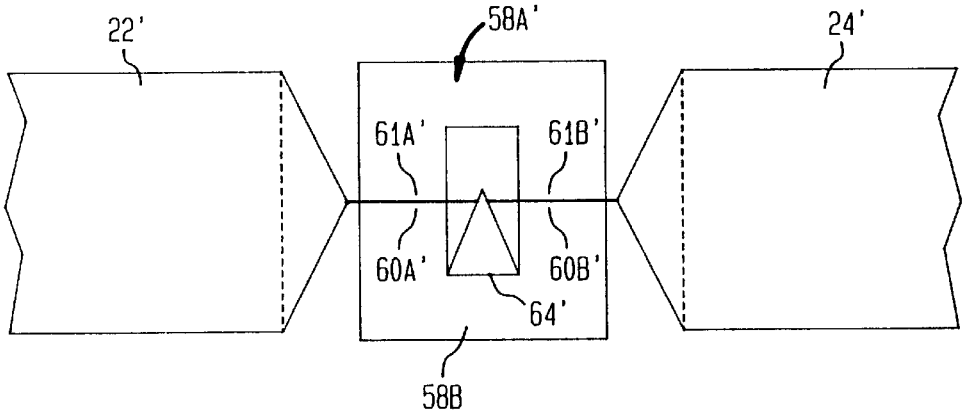
FIG. 10B shows a cross-sectional side view of the sealing jaw shown in FIG. 10A according to another embodiment of the present invention.

Referring to FIG. 10B, in other embodiments the cutting element does not abut against its opposed sealing element for severing the tubular web. In these particular embodiments, both opposed upper and lower sealing elements include two substantially parallel sealing blades which abut against one another when the sealing jaw is closed for completely sealing the tubular web. One of the upper and lower sealing elements includes a cutting blade located between the two substantially parallel sealing blades. When the sealing jaw is closed, the tubular web material between the two substantially parallel sealing blades is maintained taut so that the cutting blade may sever the tubular web material therebetween to provide individual sealed packages.

Another embodiment of the present invention includes a method for packaging one or more articles 22 surrounded by a tubular web 24. Referring to FIGS. 1 and 2, the tubular web 24 and the articles 22 move downstream along a path at a first rate of speed. The tubular web 24 and the articles 22 move to the first station 28 which includes a tacking jaw and tucking blades and is substantially similar to that described above. The opposed tacking elements 34A, 34B and tucking blades 44A, 44B of the first station 28 travel along a cyclical paths having a "D"-shaped pattern. However, the independent "D"-shaped paths of the opposed upper and lower tacking elements 34A, 34B are substantially mirror images of one another. For example, the path of the upper tacking element 66A has four stages including a first stage 68A wherein the upper tacking element 34A is engaged with the central portion 32 of the tubular web 24 for sealing the central portion 32 and is moving downstream at a second rate of speed slower than the first rate of speed, a second stage 70A wherein the upper tacking element 34A moves up and away from the central portion 32 of the tubular web 24 to disengage from the web, a third stage 72A wherein the upper tacking element 34A moves upstream and a fourth stage 74A wherein the upper tacking element 34A moves back to the start point of the cycle and re-engages the tubular web 24. The upper tacking element 34A continues to follow this "D"-shaped path for sealing successive articles 22 between the tubular web 24. As discussed above, the lower tacking element 34B follows its own cyclical path 66B which substantially mirrors that of the upper tacking element 34A, i.e., the lower tacking element 34B follows a path including a first downstream stage 68B, a second disengaging stage 70B, a third upstream stage 72B and a fourth re-engagement stage 74B. During the first stage 68B of the cycle, the lower tacking element 34B moves downstream at the second rate of speed which is slower than the first rate of speed. When the tucking blades 44A, 44B are extended for forcing the sides 46A, 46B of the tubular web 24 toward the central portion 32 thereof, the tucking blades 44A, 44B are also moving downstream at the second rate of speed. By moving the first sealing station 28 downstream at the second rate of speed which is slower than the first rate of speed, the sealing system 20 of the present invention compensates for a reduction in the downstream speed of the tubular web 24 as the web material is being partially sealed. As discussed previously, if the first station 28 continued to move downstream at the first rate of speed while partially sealing the web 24, then the first station 28 would stretch or tear the tubular web material, thereby destroying the integrity of the package.

After the article 22 has been partially sealed at the first sealing station 28, the tubular web 24 continues downstream to the second sealing station 54. The second sealing station includes the sealing jaw 56 movable between open and closed positions described above. The upper and lower sealing elements 58A, 58B also follow second "D"-shaped cyclical paths 76A, 76B whereby the movements of the upper and lower sealing elements 58A, 58B mirror one another. For example, during the first stages 78A, 78B of the respective paths, the sealing jaw 56 is closed for compressing and sealing the tubular web 24 therebetween. While the sealing jaw 56 is sealing the tubular web 24 material, the sealing jaw 56 travels downstream at a third rate of speed which is slower than the second rate of speed. The second sealing station 54 travels downstream at the still slower third rate of speed in order to account for a further reduction in the downstream speed of the tubular web 24 as the tubular web is completely sealed at the second station 54. Moving the second sealing station 54 downstream at the still slower third rate of speed minimizes the level of tension which must be placed on the tubular web during the partially sealing step and enables the system to more tightly wrap and seal the articles while using less wrapping material. During stage two 80A, 80B of the cycle, the upper and lower sealing elements 58A, 58B disengage and move away from the tubular web 24. In stage three 82A, 82B, the upper and lower sealing elements 58A, 58B move back upstream, and in stage four 84A, 84B, the elements 58A, 58B re-engage the tubular web 24 to commence another sealing cycle. The upper and lower sealing elements 58A, 58B continue to follow the "D"-shaped paths 76A, 76B for each successive article 22 being sealed.

Figure 11:
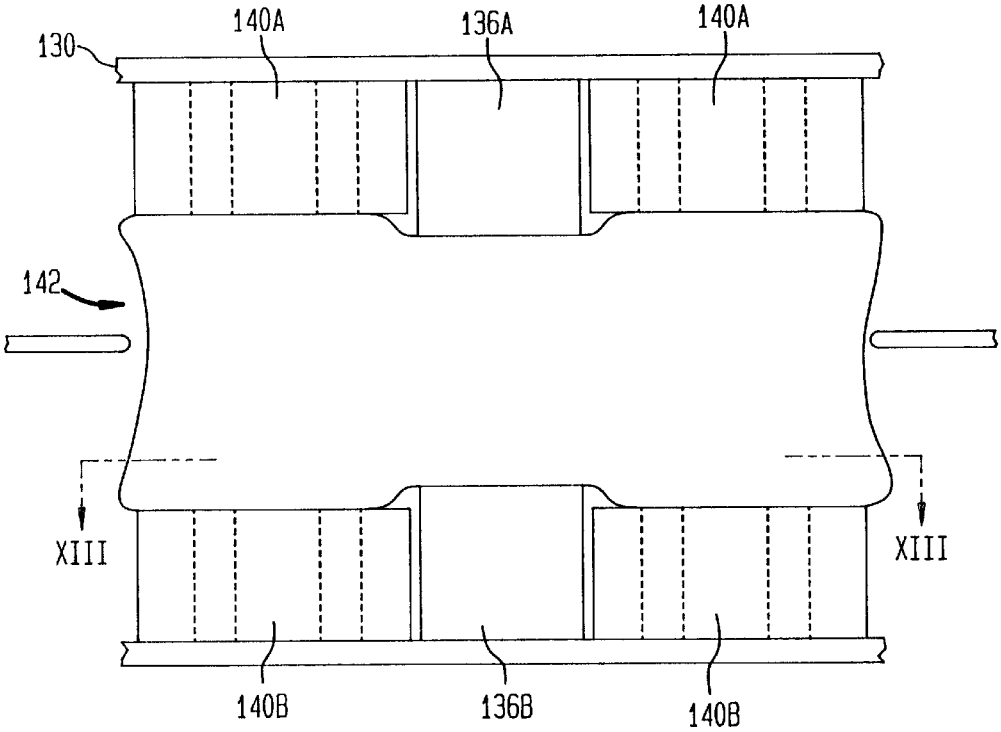
FIG. 11 shows a fragmentary view of the tacking jaw and tucking blades of FIG. 1 according to a further embodiment of the invention.

FIG. 11 shows another embodiment of the present invention whereby lateral sections 140A, 140B of upper and lower tacking elements 134A, 134B do not slope away from one another to define openings 142 on opposite sides of tacking jaw 130. The opposed lateral sections 140A, 140B are substantially parallel to one another and openings 142 are defined on the sides of tacking jaw 130 because lateral sections 140A, 140B have a lower overall height or silhouette than their respective central sections 136A, 136B. In other embodiments, the openings in the sides of the tacking jaw may be provided by forming apertures in the sides of the tacking jaw which allow the tucking blades to be between the jaw while the jaw is closed.

FIG. 12 shows a fragmentary view of a tacking jaw 230 in accordance with another embodiment of the present invention. The tacking jaw 230 includes a securing element 241 which overlies the lateral sections 240B of the tacking jaw for securing intermediate portions of the tubular web extending laterally from the central sealing sections 236B of the tacking jaw 230. In preferred embodiments, the securing element includes a clipping unit 241 which engages the intermediate portions of the tubular web during the tacking and tucking operations to hold the intermediate portions in place so that excess folds or wrinkles do not form in the web. The clipping unit 241 disengages from the tubular web after the tacking and tucking operations have been completed. In other embodiments, the securing element may include a jaw which performs the same function as the clipping unit.

Figure 13:
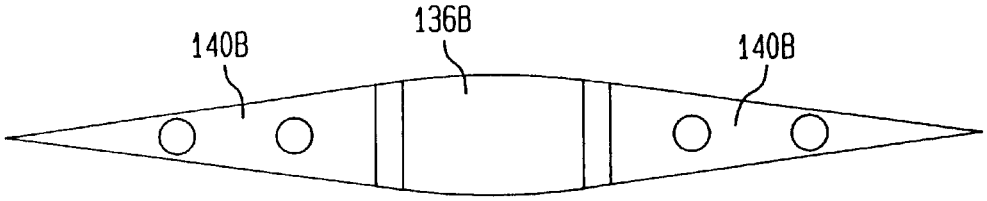
FIG. 13 shows a view of FIG. 11 along section line XIII-XIII.

FIG. 13 shows a top view of the lower tacking element of the tacking jaw 130 shown in FIG. 11. The tacking jaw 130 is relatively narrow and tapers inwardly from the central sealing section 136B toward the lateral sections 140B. The narrow and tapered design of the tacking jaw 130 minimizes the forces exerted upon the tubular web material during the tacking and tucking operations which results in increased production rates, more tightly wrapped packages and the use of less wrapping material.

Figure 14:
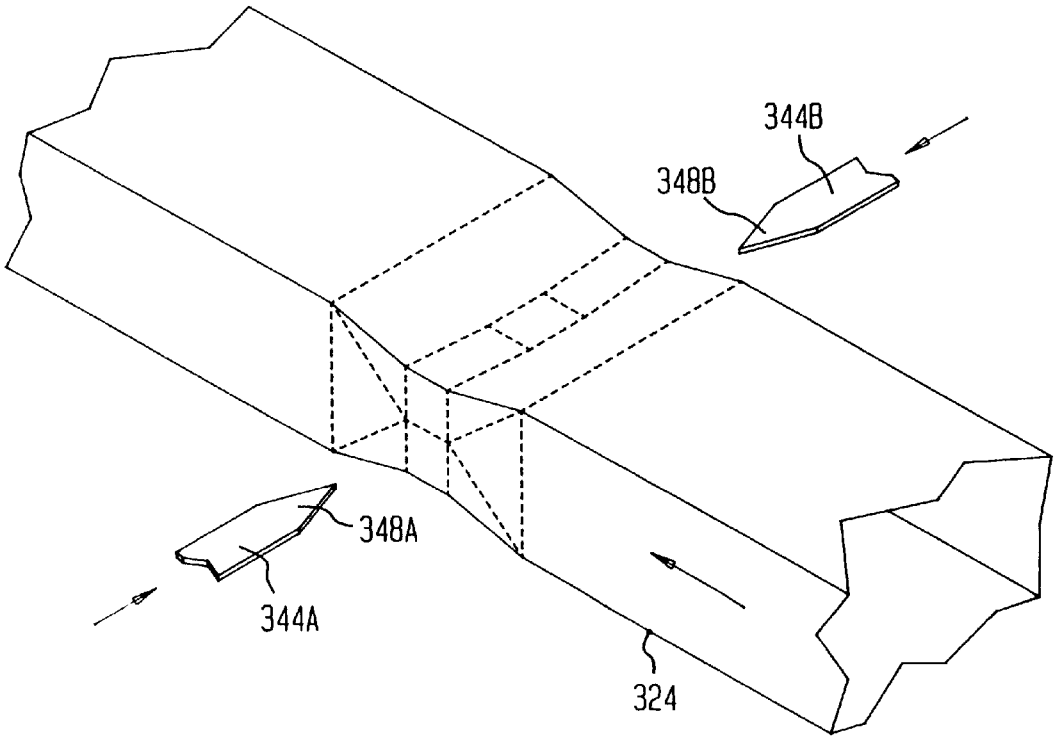
FIG. 14 shows a fragmentary view of the tucking blades shown in FIG. 1 according to still another embodiment of the present invention.

FIG. 14 shows another embodiment of the present invention wherein the interior ends 348A and 348B of the tucking blades 344A and 344B are angled or tapered to a point, such as being in the shape of an arrow. The utilization of tucking blades having tapered interior ends 348A and 348B serves to, inter alia, enhance the formation of uniform gabled ends between successive articles.

These and other variations, combinations and modifications of the features discussed above, can be employed without departing from the present invention. For example, preferred embodiments can include more than two sealing stations whereby each successive sealing station moves downstream at a slower rate of speed than the station immediately upstream from it. In other preferred embodiments, additional tucking blades can be utilized for improving control and manipulation of the tubular web during the sealing process. As such, the foregoing description of the preferred embodiments should be taken by way of illustration rather than by way of limitation of the present invention as defined by the claims.

I claim:

1. A system for packaging one or more articles surrounded by a tubular web moving downstream along a path comprising:

a station including:

a tacking jaw at a first downstream location along said path, said tacking jaw including opposed upper and lower tacking elements including opposed central sealing sections, each of said opposed tacking elements including lateral sections extending outwardly from opposite sides of said central sealing section, said lateral sections of said opposed upper and lower tacking elements including a securing element for securing intermediate portions of said tubular web extending laterally from said central sealing sections, said tacking jaw being movable between a first open position and a second closed position for sealing a central portion of said tubular web between said one or more articles, said opposed central sealing sections being in contact with one another with said tubular web therebetween while said tacking jaw is in said second closed position; and two tucking blades at said first downstream location along said path on opposite sides of said tacking jaw and said tubular web, said tucking blades being movable toward one another for forcing the sides of said tubular web toward said central portion of said tubular web while said tacking jaw is in said second closed position.

2. A system as claimed in claim 1, wherein said tacking jaw has an axis substantially perpendicular to said path and said tucking blades are movable along said axis.

3. A system as claimed in claim 2, wherein said tacking elements are substantially mirror images of one another.

4. A system as claimed in claim 3, wherein said opposed upper and lower tacking elements include opposed central sealing sections which are in contact with one another with said tubular web therebetween while said tacking jaw is in said second closed position.

5. A system as claimed in claim 1, wherein said opposed central sealing sections include knurled surfaces.

6. A system as claimed in claim 1, wherein the ends of said tucking blades are adjacent said opposed central sealing sections when said tacking jaw is in said second closed position.

7. A system as claimed in claim 4, wherein each said opposed tacking elements include lateral sections extending outwardly from opposite sides of said central sealing section along said axis of said tacking jaw.

8. A system as claimed in claim 1, wherein said lateral sections of said opposed upper and lower tacking elements define openings on opposed lateral sides of said tacking jaw for receiving said tucking blades when said tacking jaw is in said second closed position.

9. A system as claimed in claim 1, wherein said lateral sections of said opposed upper and lower tacking elements slope away from one another.

10. A system as claimed in claim 1, wherein each of said upper and lower tacking elements tapers away from the other of said upper and lower tacking elements in a direction from said central sealing section thereof toward said lateral sections.

11. A system as claimed in claim 7, wherein said lateral sections of said opposed upper and lower tacking elements include a securing element for securing intermediate portions of said tubular web extending laterally from said central sealing sections.

12. A system as claimed in claim 1, wherein said securing element includes one or more vacuum holes.

13. A system as claimed in claim 1, wherein said securing element includes a clipping unit.

14. A system as claimed in claim 3, wherein said opposed upper and lower tacking elements include a heating element for heating the central portion of said tubular web while said tacking jaw is in said second closed position.

15. A system as claimed in claim 1, wherein said system comprises a first station and further comprising:

a second station downstream from said first station including a sealing jaw substantially perpendicular to said path, said sealing jaw extending completely across said tubular web and being movable between an open position and a closed position for completely sealing said tubular web between said articles.

16. A system as claimed in claim 15, including moving means for moving said tubular web at a first rate of speed upstream from said first station.

17. A system as claimed in claim 16, wherein said tacking jaw at said first station is movable downstream at a second rate of speed slower than said first rate of speed while said tacking jaw is in said second closed position, and said sealing jaw at said second station is movable downstream at a third rate of speed slower than said second rate of speed while said sealing jaw is in said closed position.

18. A system as claimed in claim 15, wherein said sealing jaw includes opposed upper and lower sealing elements, each said sealing element including two substantially parallel sealing blades.

19. A system as claimed in claim 18, wherein said two substantially parallel sealing blades include knurled surfaces.

20. A system as claimed in claim 18, wherein at least one of said opposed sealing elements includes a cutting element between said two substantially parallel sealing blades for severing individual sealed units of said articles from said tubular web.

21. A system as claimed in claim 18, wherein said opposed sealing elements include a heating element connected thereto for heat sealing said tubular web while said sealing jaw is in said closed position.

22. A method for packaging one or more articles surrounded by a tubular web moving downstream along a path comprising the steps of:

(a) providing a tacking jaw including opposed upper and lower tacking elements including opposed central sealing sections, each of said opposed tacking elements including lateral sections extending outwardly from opposite sides of said central sealing section, said lateral sections including a securing element, said tacking jaw disposed at a first downstream location along said path and being movable between a first open position and a second closed position;

(b) providing tucking blades including ends at said first downstream location on opposite sides of said tacking jaw and said tubular web;

(c) positioning said ends of said tucking blades adjacent said opposed central sealing sections and forcing the sides of said tubular web toward a central portion of said tubular web; and (d) closing said tacking jaw and abutting said opposed central sealing sections against one another for sealing said central portion of said tubular web therebetween and securing an intermediate portion of said tubular web extending laterally from said central sealing sections and sealing said central portion of said tubular web between said one or more articles during said positioning step.

23. A method as claimed in claim 22, wherein said tacking jaw has an axis substantially perpendicular to said path, said tucking blades traversing said axis during said moving step.

24. A method as claimed in claim 23, wherein said tacking elements are substantially mirror images of one another.

25. A method as claimed in claim 24, wherein said opposed upper and lower tacking elements include opposed central sealing sections, said closing step including abutting said opposed central sealing sections against one another for sealing said central portion of said tubular web therebetween.

26. A method as claimed in claim 25, wherein said moving step includes positioning the ends of said tucking blades adjacent said opposed central sealing sections.

27. A method as claimed in claim 26, wherein each said opposed tacking elements include lateral sections extending outwardly from opposite sides of said central sealing section along said axis of said tacking jaw.

28. A method as claimed in claim 22, wherein said lateral sections of said opposed upper and lower tacking elements define openings on opposed lateral sides of said tacking jaw, said moving step further including passing said tucking blades between said openings during said closing step.

29. A method as claimed in claim 22, wherein said lateral sections of said opposed upper and lower tacking elements slope away from one another.

30. A method as claimed in claim 27, wherein said lateral sections include a securing element, said closing step including securing an intermediate portion of said tubular web extending laterally from said central sealing sections.

31. A method as claimed in claim 22, wherein said securing element includes one or more vacuum holes in said lateral sections, said securing step including activating a vacuum through said one or more vacuum holes.

32. A method as claimed in claim 22, wherein said securing element includes a clip unit on said lateral sections, said securing step including engaging said intermediate portion of said tubular web between said central portion and said sides of said tubular web with said clip unit.

33. A method as claimed in claim 22, wherein said closing step includes heating said central portion of said tubular web.

34. A system for packaging one or more articles surrounded by a tubular web moving downstream along a path comprising a first station including a tacking jaw at a first downstream location along said path, said tacking jaw being movable between a first open position and a second closed position for sealing a central portion of said tubular web between said one or more articles, and two tucking blades at said first downstream location along said path on opposite sides of said tacking jaw and said tubular web, said tucking blades being movable toward one another for forcing the sides of said tubular web toward said central portion of said tubular web while said tacking jaw is in said second closed position, moving means for moving said tubular web at a first rate of speed upstream of said first station, and a second station downstream from said first station including a sealing jaw substantially perpendicular to said path, said sealing jaw extending completely across said tubular web and being movable between an open position and a closed position for completely sealing said tubular web between said articles, said tacking jaw at said first station being movable downstream at a second rate of speed slower than said first rate of speed while said tacking jaw is in said second closed position, and said sealing jaw at said second station being movable downstream at a third rate of speed slower than said second rate of speed while said sealing jaw is in said closed position.

35. A system as claimed in claim 34, wherein said tacking jaw has an axis substantially perpendicular to said path and includes opposed upper and lower tacking elements including opposed central sealing sections which are in contact with one another and said tubular web therebetween while said tacking jaw is in said second closed position, and wherein said tucking blades are movable along said axis.

36. The system as claimed in claim 35, wherein said opposed central sealing sections include gnarled surfaces.

37. A system as claimed in claim 35, wherein each of said opposed tacking elements includes lateral sections extending outwardly from opposite sides of said central sealing section along said axis of said tacking jaw.

38. A system as claimed in claim 35, wherein said lateral sections of said opposed upper and lower tacking elements define openings on opposed lateral sides of said tacking jaw for receiving said tucking blades when said tacking jaw is in said second closed position.

39. The system as claimed in claim 35, wherein said lateral sections of said opposed upper and lower tacking elements include a securing element for securing intermediate portions of said tubular web extending laterally from said central sealing sections.

40. A system as claimed in claim 39, wherein said securing element includes one or more vacuum holes.

41. A system as claimed in claim 39, wherein said securing element includes a clipping unit.

42. A system as claimed in claim 34, wherein said sealing jaw includes opposed upper and lower sealing elements, each said sealing element including two substantially parallel sealing blades.

43. A system as claimed in claim 42, wherein at least one of said opposed sealing elements include a cutting element between said two substantially parallel sealing blades for severing individual sealed units of said articles from said tubular web.

44. A system as claimed in claim 42, wherein said opposed sealing elements include a heating element connected thereto for heat sealing said tubular web while said sealing jaw is in said closed position.

45. A method for packaging one or more articles surrounded by a tubular web moving downstream along a path comprising the steps of:

(a) providing a tacking jaw at a first downstream location along said path, said tacking jaw being movable between a first open position and a second closed position;

(b) providing tucking blades at said first downstream location on opposite sides of said tacking jaw and said tubular web;

(c) moving said tucking blades toward one another and forcing the sides of said tubular web toward a central portion of said tubular web;

(d) closing said tacking jaw and sealing said central portion of said tubular web between said one or more articles during said moving step;

(e) moving said tubular web downstream at a first rate of speed before said closing step;

(f) providing a second station downstream from said first station, said second station including a sealing jaw having a longitudinal axis substantially perpendicular to said path;

(g) activating said sealing jaw and completely sealing said tubular web between said articles; and (h) moving said tacking jaw downstream at a second rate of speed slower than said first rate of speed during said closing step and moving said sealing jaw downstream at a third rate of speed slower than said second rate of speed during said activating step.

46. A method as claimed in claim 45, wherein said tacking jaw includes opposed upper and lower tacking elements including opposed central sealing sections, and an axis substantially perpendicular to said path, said tucking blades traversing said axis during said moving step, and said closing step including abutting said opposed central sealing sections against one another for sealing said central portion of said tubular web therebetween.

47. A method as claimed in claim 46, wherein said moving step includes positioning the ends of said tucking blades adjacent said opposed central sealing section.

48. A method as claimed in claim 47, wherein said opposed tacking elements include lateral sections extending outwardly from opposite sides of said central sealing section along said axis of said tacking jaw.

49. A method as claimed in claim 48, wherein said lateral sections of said opposed upper and lower tacking elements define openings on opposed lateral sides of said tacking jaw, said moving step further including passing said tucking blade between said openings during said closing step.

50. A method as claimed in claim 48, wherein said lateral sections include a securing element, said closing step including securing an intermediate portion of said tubular web extending laterally from said central sealing section.

51. A method as claimed in claim 50, wherein said securing element includes one or more vacuum holes in said lateral sections, said securing step including activating a vacuum through said one or more vacuum holes.

52. A method as claimed in claim 45, further comprising the step of cutting across said completely sealed portion of said tubular web for providing individual sealed units of said articles.

53. A method as claimed in claim 45, further comprising the step of heating said tubular web during said activating step.

* * * * *

UNITED STATES PATENT AND TRADEMARK OFFICE

CERTIFICATE OF CORRECTION

PATENT NO. : 5,966,907
DATED : October 19, 1999
INVENTOR(S) : Robert P. Julius

It is certified that error appears in the above-identified patent and that said Letters Patent is hereby corrected as shown below:

Claim 4, 7, 11, 25, 26, 27, 30,
Delete in its entirety.

Claim "5"
Should read claim -- 4 --.

Claim "6"
Should read claim -- 5 --.

Claim "8"
Should read claim -- 6 --.

Claim "9"
Should read claim -- 7 --.

Claim "10"
Should read claim -- 8 --.

Claim "12"
Should read claim -- 9 --.

Claim "13"
Should read claim -- 10 --.

UNITED STATES PATENT AND TRADEMARK OFFICE

CERTIFICATE OF CORRECTION

PATENT NO. : 5,966,907
DATED : October 19, 1999
INVENTOR(S) : Robert P. Julius

It is certified that error appears in the above-identified patent and that said Letters Patent is hereby corrected as shown below:

Claim "14"
Should read claim -- 11 --.

Claim "15"
Should read claim -- 12 --.

Claim "16"
Should read claim -- 13 --; and within that claim in line 1, "15" should read -- 12 --.

Claim "17"
Should read claim -- 14 --; and within that claim in line 1, "16" should read -- 13 --.

Claim "18"
Should read claim -- 15 --; and within that claim in line 1, "15" should read -- 12 --.

Claim "19"
Should read claim -- 16 --; and within that claim in line 1, "18" should read -- 15 --.

Claim "20"
Should read claim -- 17 --; and within that claim in line 1, "18" should read -- 15 --.

Claim "21"
Should read claim -- 18 --; and within that claim in line 1, "18" should read -- 15 --.

Claim "22"
Should read claim -- 19 --.

UNITED STATES PATENT AND TRADEMARK OFFICE

CERTIFICATE OF CORRECTION

PATENT NO. : 5,966,907
DATED : October 19, 1999
INVENTOR(S) : Robert P. Julius

It is certified that error appears in the above-identified patent and that said Letters Patent is hereby corrected as shown below:

Claim "23"
Should read claim -- 20 --; and within that claim in line 1, "22" should read -- 19 --.

Claim "24"
Should read claim -- 21 --; and within that claim in line 1, "23" should read -- 20 --.

Claim "28"
Should read claim -- 22 --; and within that claim in line 1, "22" should read -- 19 --.

Claim "29"
Should read claim -- 23 --; and within that claim in line 1, "22" should read -- 19 --.

Claim "31"
Should read claim -- 24 --; and within that claim in line 1, "22" should read -- 19 --.

Claim "32"
Should read claim -- 25 --; and within that claim in line 1, "22" should read -- 19 --.

Claim "33"
Should read claim -- 26 --; and within that claim in line 1, "22" should read -- 19 --.

Insert claim --27. A method as claimed in claim 19, further comprising the steps of providing a second station downstream from said first station including a sealing jaw having a longitudinal axis substantially perpendicular to said linear path; and activating said sealing jaw and completely sealing said tubular web between said articles.--

Insert claim --28. A method as claimed in claim 27, including moving said tubular web downstream at a first rate of speed before said closing step.--

Insert claim --29. A method as claimed in claim 28, including moving said tacking jaw downstream at a second rate of speed slower than said first rate of speed during said closing step and moving said sealing jaw downstream at a third rate of speed slower than said second rate of speed during said activating step.--

UNITED STATES PATENT AND TRADEMARK OFFICE

CERTIFICATE OF CORRECTION

PATENT NO. : 5,966,907
DATED : October 19, 1999
INVENTOR(S) : Robert P. Julius

It is certified that error appears in the above-identified patent and that said Letters Patent is hereby corrected as shown below:

Insert claim --30. A method as claimed in claim 27, wherein said sealing jaw extends completely across said tubular web, and includes opposed upper and lower sealing elements, said activating step including compressing said tubular web between said opposed upper and lower sealing elements.--

Insert claim --31. A method as claimed in claim 30, wherein said upper and lower sealing elements overlie said sealed central portion of said tubular web during said compressing step.--

Insert claim --32. A method as claim in claim 27, further comprising the step of cutting across said completely sealed portion of said tubular web for providing individual sealed units of said articles.--

Insert claim --33. A method as claimed in claim 27, further comprising the step of heating said tubular web during said activating step.--

Signed and Sealed this

Twenty-first Day of August, 2001

*Attest:*

Nicholas P. Godici

NICHOLAS P. GODICI

*Attesting Officer*

*Acting Director of the United States Patent and Trademark Office*